US005374109A

United States Patent [19]

Wortman

[11] Patent Number: 5,374,109

[45] Date of Patent: Dec. 20, 1994

[54] THREE POINT CROSS-LEGGED SUPPORT SEAT

[76] Inventor: Alex Wortman, 1705 Wells, Ann Arbor, Mich. 48104

[21] Appl. No.: 83,053

[22] Filed: Jun. 25, 1993

Related U.S. Application Data

[63] Continuation-in-part of Ser. No. 531,005, May 31, 1990, abandoned.

[51] Int. Cl.[5] ..... A47C 7/02

[52] U.S. Cl. ..... 297/452.22; 297/423.41

[58] Field of Search ..... 297/452.22, 456.21, 297/452.76, 450.15, 450.16, 423.16, 423.41; 5/652, 653, 654, 657

[56] References Cited

U.S. PATENT DOCUMENTS

| | | | |
|---|---|---|---|
| D. 260,125 | 8/1981 | Rogers | 5/653 X |
| 2,199,479 | 5/1940 | Cappel | 297/452.22 X |
| 3,222,694 | 12/1965 | Schick | 5/653 |
| 3,312,987 | 4/1967 | Emery . | |
| 4,571,761 | 2/1986 | Perlin | 5/652 |
| 4,673,216 | 6/1987 | Alfer | 297/452.22 X |
| 4,824,174 | 4/1989 | Dunn, Sr. | 297/452.22 X |
| 4,951,334 | 8/1990 | Maier | 5/653 |

*Primary Examiner*—Jose V. Chen
*Attorney, Agent, or Firm*—James M. Deimen

[57] ABSTRACT

A stable seat and back support specially configured to elevate the buttocks and hips above the knees and to shift a portion of the user's weight from the buttocks to the knees and forelegs in a cross-legged position. The seat is sized and configured to position the user's body for meditation and relaxation in a solid stable position that combines a sitting and kneeling posture. In particular, the height and depth of the chair are sized to encourage the cross-legged sitting-kneeling posture. The depth is sized to purposely limit support of the thighs and the height selected for vertical posture of the user's back in the sitting-kneeling cross-legged position. A shallow notch is formed in the front of the seat to properly position the user's inside heel in the cross-legged position and thereby to help stabilize the seat and the position of the person using the seat.

12 Claims, 2 Drawing Sheets

THREE POINT CROSS-LEGGED SUPPORT SEAT

This is a continuation-in-part of U.S. application No. 07/531,005, filed May 31, 1990 now abandoned.

BACKGROUND OF THE INVENTION

The field of the invention pertains to seats and cushions to assist in meditation and relaxation, and in particular, to provide and encourage better sitting posture.

Back pain and inner tension (stress) are two of the most common health problems in the United States. These problems affect people of all ages and in all walks of life.

People can be helped to eliminate or reduce back pain by learning to stretch and strengthen appropriate muscles and by learning to sit with proper posture.

To reduce inner tension, numerous health practitioners have documented the benefits of taking a period of time each day to sit and meditate. This technique is frequently recommended to help people to relieve stress, lower their blood pressure, and improve their physical and emotional health. One of the leading researchers in this area is Herbert Benson, M.D., cardiologist, associate professor at the Harvard Medical School. and author of an initial work on this subject matter entitled, "The Relaxation Response", William Morrow and Company, Inc., New York, 1975.

A number of devices have been invented to assist in relieving back pain and stress, and to assist in meditation and relaxation. A basic seat structure may be that disclosed for a vehicle in U.S. Pat. No. 3,529,866. Such seats, which generally position the legs straight forward for driving, have not generally lent themselves for good vertical meditative posture. To reduce the fatigue frequently associated with vehicle seats and other seats, back rest cushions with therapeutic shapes have been developed. An example of such a therapeutic cushion is disclosed in U.S. Pat. No. 4,535,495. Such cushions, however, do not function as seats or provide any vertical support.

A substantially different approach to back support in a sitting position, either legs forward or cross-legged, is illustrated in U.S. Pat. No. 4,773,106. While providing the advantage of portability, this device does not provide support to the buttocks and upper thighs nor does the device appear applicable to meditation and reduction of stress.

Chairs and cushions have been developed to assist in sitting in the cross-legged meditative position. U.S. Pat. No. 3,890,004 discloses a chair-like structure with a back rest. This structure provides full buttocks and thigh support with the knees elevated to about hip elevation in the cross-legged sitting position. U.S. Pat. No. 4,673,216 discloses a seat comprising a pair of shaped cushions to assist in sitting in the cross-legged position. This structure also provides buttocks and full length thigh support with the knees elevated to about hip elevation but also provides a large opening notch for both feet and lower legs.

Other chairs and devices have been developed for providing better comfort and posture in the kneeling or combined sitting and kneeling position. The "Balance Chair" has become popular by providing a forwardly-downwardly tilted seat and a backwardly-tilted pad that provides support for substantially the length of the forelegs. This seat, however, relies on parallel placement of the forelegs and is not suitable for the cross-legged meditative position. The "Santhosh" sitting bench provides a tiltable bench for a sitting-kneeling position with the forelegs parallel and extending under the bench. The buttocks and upper portions of the thighs are supported with this bench. U.S. Pat. No. 4,394,049 discloses a kneeling device for meditation and prayer as well as other activities.

To further improve posture and comfort for meditation and relaxation, applicant has developed the new seat disclosed below.

SUMMARY OF THE INVENTION

The invention comprises a stable seat and back support specially configured to elevate the buttocks and hips above the knees and to shift a portion of the user's weight from the buttocks to the knees and forelegs in the cross-legged position. In essence, the major function of the present invention is to enable the user to maintain a solid stable position on the floor in a combined sitting and kneeling posture. In the new "three-point cross-legged support" concept the buttocks are raised and a portion of the user's weight is distributed onto each leg.

The purpose of the present invention is to enable the user to assume a cross-legged combined sitting and kneeling position that offers the following advantages:

(1) The seat causes the user to keep the spine straight and vertical and the body relaxed;

(2) The position of the user takes some of the body's weight off the buttocks and distributes a portion onto each leg. This position takes some weight off tile vertebrae column, the coccyx, and other bones involved in sitting.

(3) The position of the user on the seat provides an optimal meditative cross-legged yoga posture (the preferred combination of sitting and kneeling); as this posture tends to evoke a physical feeling of being centered, it becomes easier to simultaneously experience emotional, mental, and spiritual levels of centeredness;

(4) The posture tilts the pelvis forward and relaxes the diaphragm, putting the user in an optimal position to breathe with a natural lifting and sinking of the diaphragm; and (5) This specific sitting position opens the hip joints, and stretches muscles in the upper legs and pelvic area.

The height of the seat is crucial to the proper position of the buttocks, knees and lower legs. The height and depth of the seat allow the user's legs to drop naturally in a downward direction, and make it comfortable to maintain a three-point combined sitting and kneeling cross-legged meditative position.

If the seat is excessively high, the user is pitched too far forward, causing the buttocks to slide off the seat and thrusting most of the weight onto the crossed legs. The forward pitch not only makes the position uncomfortable, but also negates the objective of three-point support in which the user's weight is about equally distributed between the buttocks and each knee.

If the seat is excessively low, the user's weight is shifted more to the buttocks, thereby losing the beneficial effect of the three-point support. The proper height permits the user's forelegs along with the knees to provide support thus avoiding excessive loads on the knees.

A key feature of the new seat is the small notch or indentation in the front center of the seat which provides clearance for the heel of either the right or the left foot to be tucked under the user into the front of the seat. Since the seat depth is purposely shallow to permit the thighs to extend downwardly toward the floor, the seat only provides the minimum area necessary to support the buttocks. Without the center notch or indentation, the user would be forced to keep the back foot and heel in front of the seat, thereby creating a problem similar to having a seat that is too high: the buttocks would tend to slide off the seat, and the desired firm base of support with equal three-point weight distribution would be lost.

In addition to using the invention for the health advantages mentioned above, the new seat can also be used simply as a comfortable floor-level seat. The seat is useful for informal group discussions, for watching television, or for parents and pre-school teachers to sit comfortably at eye level while talking and playing with children.

DESCRIPTION OF THE PREFERRED EMBODIMENT

Figure 1:
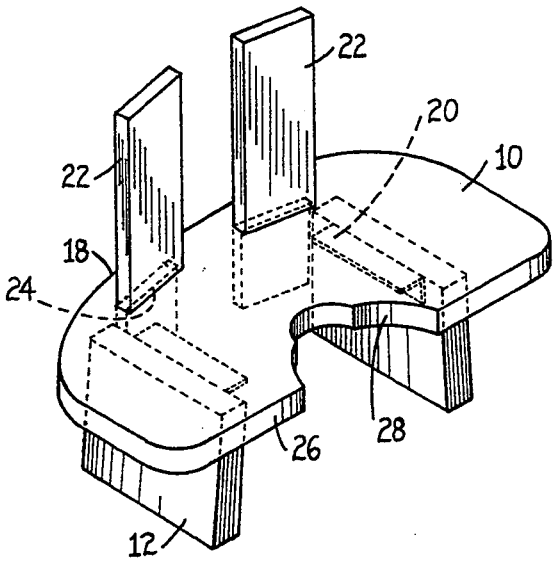
FIG. 1 is a perspective view of the new balance seat.
Figure 2:
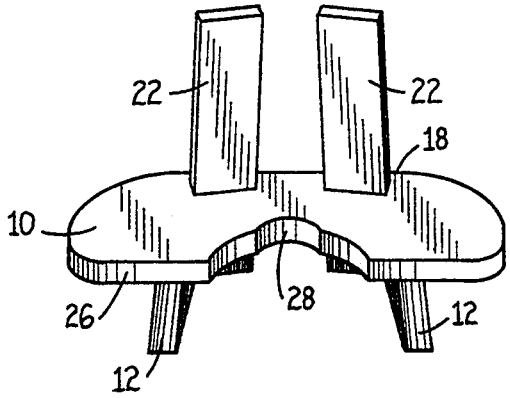
FIG. 2 is a front view of the seat.
Figure 3:
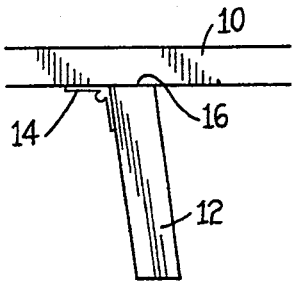
FIG. 3 is a detail view of the hinged support for the seat.
Figure 4:
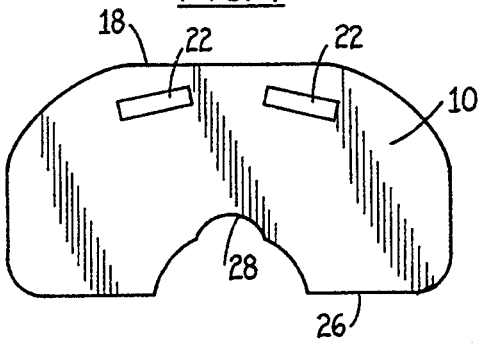
FIG. 4 is a top plan view of the seat.

Illustrated in the figures and description below are three alternative forms of the three point balance seat. FIGS. 1 through 4 illustrate a substantially wood version of the seat having an upper supporting surface 10 upon which the buttocks of the user are placed. Extending beneath the supporting surface 10 are a pair of legs 12. The legs 12 extend substantially front to rear of the supporting surface 10 and are canted outwardly toward the ends of the seat and toward the floor.

The legs 12 are attached to the underside of the supporting surface 10 with hinges 14 that enable the legs 12 to be folded underneath for better portability of the seat. The upper edge 16 of each leg 12 is cut on a slight bias to provide the outward cant of each leg.

Adjacent the back edge 18 of the supporting surface 10 are a pair of slots 20 that pierce the supporting surface. Extending through each slot 20 are back rests 22. The back rests 22 are formed with an undercut at 24 whereby only the lower portion of each back rest can be inserted through the slot 20.

Figure 5:
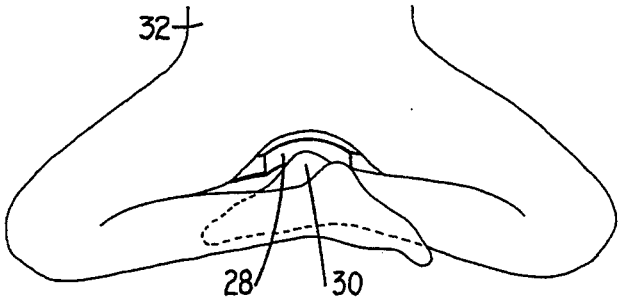
FIG. 5 is a front view of the sitting posture on the seat.

The front edge 26 of the supporting surface 10 is formed with a small notch 28 that permits the heel 30 of the user 32 to be positioned therein as best shown in FIG. 5. For proper posture the height of the supporting surface 10 is not sufficient to permit the heels or feet to fit beneath the supporting surface 10. Absent the notch 28, however, the user's feet are positioned too far forward for proper sitting posture, therefore the small notch 26 is an integral part of the seat for proper posture in the three point sitting-kneeling position of the user 32.

Figure 6:
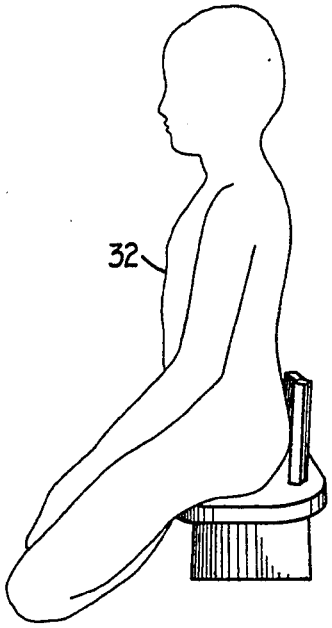
FIG. 6 is a left side view of the sitting posture on the seat.

In addition to providing some back support the main purpose of the back rest 22 is to assure that only the back portion of the buttocks rests on the supporting surface 10 thereby permitting the user's thighs to extend downwardly as best shown in the side view of the user, FIG. 6. Thus, the knees and forelegs substantially engage the floor in the cross-legged position as shown in FIG. 5. The height of the supporting surface 10 on the legs 12 and the depth of the supporting surface, front 26 to the back rests 22, are sized to provide support for the buttocks without support for the thighs and therefore are to some extent dependent upon the size of the user. For an adult male of average height these dimensions are about 5 inches for the height and 7 inches for the depth. The depth of the notch is less than 33% of the seat depth.

Figure 7:
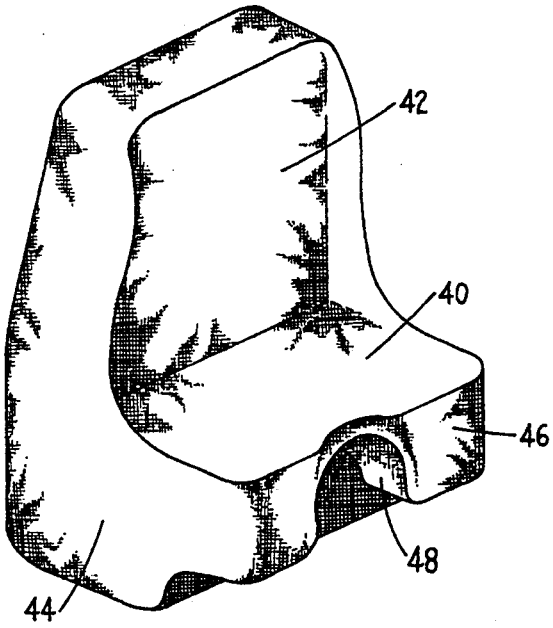
FIG. 7 is a perspective view of a second version of the seat.

FIG. 7 illustrates in perspective a cushioned form of the three point balance seat. The cushioned seat comprises a forward supporting surface 40 and a back rest 42 resting upon a low integral support 44 that extends to the floor. The front 46 of the supporting surface 40 includes a shallow notch or indentation 48 for the inner most heel of the user who sits-kneels cross-legged on the seat. This version of the seat is constructed of cloth covered foam shaped to provide the seat shape but with sufficient flexibility to provide a measure of comfort to the buttocks of the user. As with the above wooden version of the seat, the depth of the supporting surface, front 46 to back rest 42 is only sufficient to support the buttocks without supporting or interfering with the downwardly extending thighs of the user in the proper sitting-kneeling cross-legged posture. Likewise, the height is limited to providing the proper vertical posture without a tendency to pitch the user too far forward or add additional weight to the knees and forelegs.

Figure 8:
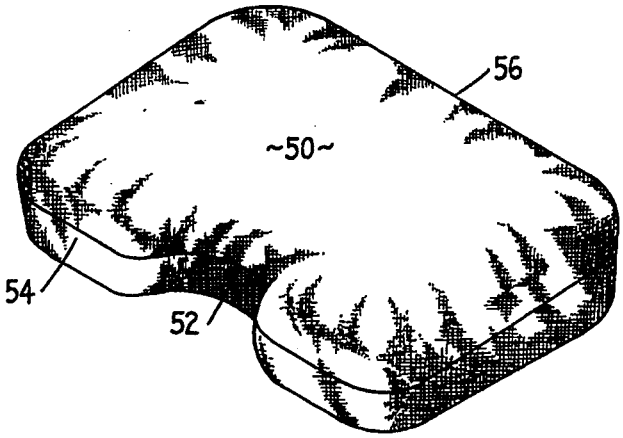
FIG. 8 is a perspective view of a third version of the seat.

FIG. 8 illustrates in perspective a third version of the three point balance seat. In this version the supporting surface 50 is formed by an inflatable cushion covered with a non-slip surface such as an integral cloth covering. The inflatable seat includes the small notch 52 in the front 54 of the supporting surface 50 but, as an inflatable cushion, is sized in height to rest directly on the floor and provide the correct height as a function of inflation pressure and upper body weight of the user. The front 54 to back 56 depth of the seat is sized to force the user to only place the user's buttocks on the supporting surface 50. The back 56 is slightly higher than the front 54. If the user attempts to sit too far backward the user will not be able to properly place the user's heel in the notch 52 nor sit vertically on the seat with legs crossed. Thus, despite the lack of a back rest the inflatable version of the seat also provides for proper posture in the three point cross-legged sitting-kneeling position.

Because of the softness of the cushioned and inflatable versions of the seat, the notch depth may be less than 20% of the seat depth. Although the seat is directed to usage by adults and the dimensions illustrated above are for adult males of average size, the size of the seat should be modified for persons of small stature or great stature. Since the human body assumes generally the same proportions with respect to height regardless of height above the age of five, the modifications to the seat may be in approximate proportion to the seat for the average adult male. Thus, the ratio should remain about 5 to 7 for height to depth and less than 33% or 20% for notch depth in hard or soft seats, respectively.

Whether in the hard or cushioned alternative the notch tends to wrap the heel as it is tucked in the notch. With the heel in the notch the user is better centered and stabilized on the seat.

I claim:

1. A stable meditation and posture seat for a cross-legged three-point kneeling position comprising buttocks supporting means having top and bottom substantially planar surfaces of sufficient width and limited horizontal depth to support only the buttocks leaving the thighs unsupported, a support beneath has been inserted after "means"; line 5, and directly connected to the bottom surface of the buttocks supporting means, said support of sufficient height to provide the kneeling position, and a small single heel accepting means formed as a notch in the front portion of the buttocks supporting means extending from said top to said bottom surface, said heel accepting means substantially centrally positioned relative to the width of the buttocks supporting means whereby in the kneeling position the heel accepting means can receive only the rearward most heel of the user.

2. The meditation and posture seat of claim 1 including a back rest extending upwardly from the back portion of the buttocks supporting means, said back rest constraining the buttocks to rest only the rearward portion of the buttocks on the buttocks supporting means.

3. The meditation and posture seat of claim 2 wherein said buttocks supporting means and back rest comprise a cushioned construction.

4. The meditation and posture seat of claim 3 wherein the depth of the heel accepting means is less than 20% of the horizontal depth.

5. The meditation and posture seat of claim 2 wherein said buttocks supporting means and back rest comprise a rigid material, said support also comprising rigid supports.

6. The meditation and posture seat of claim 5 wherein the depth of the heel accepting means is less than 33% of the horizontal depth.

7. The meditation and posture seat of claim 1 wherein the ratio of buttocks supporting means height to horizontal depth is substantially 5 to 7 and the depth of the heel accepting means is less than 33% of the horizontal depth.

8. The meditation and posture seat of claim 1 wherein said support comprises an inflatable body, the buttocks supporting means comprising substantially all of the upper surface of the body.

9. A stable meditation and posture seat for a cross-legged three-point kneeling position comprising horizontal buttocks supporting means having top and bottom substantially planar surfaces of sufficient width to support both buttocks and horizontal depth of substantially seven inches thereby being limited to support only the buttocks and leaving the thighs unsupported, a support beneath has been inserted after "means"; line 5, and directly connected to the bottom surface of the buttocks supporting means, said support limited in height to substantially five inches to provide the kneeling position, and small single heel accepting means formed as a notch in the front portion of the buttocks supporting means extending from said top to said bottom surface, said heel accepting means substantially centrally positioned relative to the width of the buttocks supporting means whereby in the kneeling position the heel accepting means can receive only the rearwardmost heel of the user.

10. The meditation and posture seat of claim 9 wherein the depth of the heel accepting means is less than 20% of the horizontal depth and the buttocks supporting means is cushioned.

11. The meditation and posture seat of claim 9 wherein the depth of the heel accepting means is less than 33% of the horizontal depth and the buttocks supporting means comprises a rigid material.

12. The meditation and posture seat of claim 9 wherein said support comprises an inflatable body, the buttocks supporting means comprising substantially all of the upper surface of the body.

* * * * *